United States Patent [19]

Bruce

[11] Patent Number: 5,050,387

[45] Date of Patent: Sep. 24, 1991

[54] METHOD AND CONTAINER FOR STORING AND DISTRIBUTION OF FOODSTUFFS

[75] Inventor: Hans Bruce, Stockholm, Sweden

[73] Assignee: Pallet-Cooler KB, Märsta, Sweden

[21] Appl. No.: 476,480

[22] PCT Filed: Feb. 24, 1989

[86] PCT No.: PCT/SE89/00080

§ 371 Date: Jul. 30, 1990

§ 102(e) Date: Jul. 30, 1990

[87] PCT Pub. No.: WO89/08061

PCT Pub. Date: Sep. 8, 1989

[30] Foreign Application Priority Data

Mar. 2, 1988 [SE] Sweden ..... 8800743

[51] Int. Cl.[5] ..... B65B 63/08

[52] U.S. Cl. ..... 62/60; 62/438; 62/457.2; 62/530

[58] Field of Search ..... 62/438, 457.2, 530, 62/372, 463, 60

[56] References Cited

U.S. PATENT DOCUMENTS

| | | | |
|---|---|---|---|
| Re. 19,950 | 4/1936 | Rice, Jr. | 62/530 X |
| 1,551,709 | 9/1925 | Stoll | 62/457.2 X |
| 1,571,438 | 2/1926 | Schopf | 62/457.2 X |
| 2,239,128 | 4/1941 | Sykes | 62/457.2 X |
| 2,400,742 | 5/1946 | Clerc | 62/457.2 X |
| 2,589,577 | 3/1952 | Rosenthal et al. | 62/530 X |
| 2,781,643 | 2/1957 | Fairweather | 62/463 X |
| 3,236,206 | 2/1966 | Willinger | 62/457.2 X |
| 4,324,111 | 4/1982 | Edwards | 62/530 X |
| 4,498,312 | 2/1985 | Schlosser | 62/457 |
| 4,882,914 | 11/1989 | Haines-Keeley et al. | 62/530 X |

FOREIGN PATENT DOCUMENTS

| | | |
|---|---|---|
| 0139812 | 3/1984 | European Pat. Off. . |
| 0157751 | 9/1985 | European Pat. Off. . |
| 2303734 | 10/1976 | France . |
| 454686 | 5/1988 | Sweden . |
| 2186067 | 8/1987 | United Kingdom . |

*Primary Examiner*—Lloyd L. King

*Attorney, Agent, or Firm*—Beveridge, DeGrandi & Weilacher

[57] ABSTRACT

A method and apparatus for maintaining an intended temperature at or close to 0° C. in products affected by variations in temperature, during transport and storage at an ambient temperature deviating from 0° C., while using a container which holds the products and whose walls render heat transfer difficult. The method includes the steps of arranging adjacent the container walls, bottom, lid and the like compartments receiving water or a water mixture so as to provide a water-containing confinement enclosing the product-receiving space in the container from all sides. The container and the water in its wall compartments are then cooled so as to freeze the water. The products are then inserted in the container after it has been moved to a room having a temperature adapted to the products. The container is then closed and used for the transportation and/or subsequent storage of the products.

9 Claims, 1 Drawing Sheet

METHOD AND CONTAINER FOR STORING AND DISTRIBUTION OF FOODSTUFFS

Figure 1:
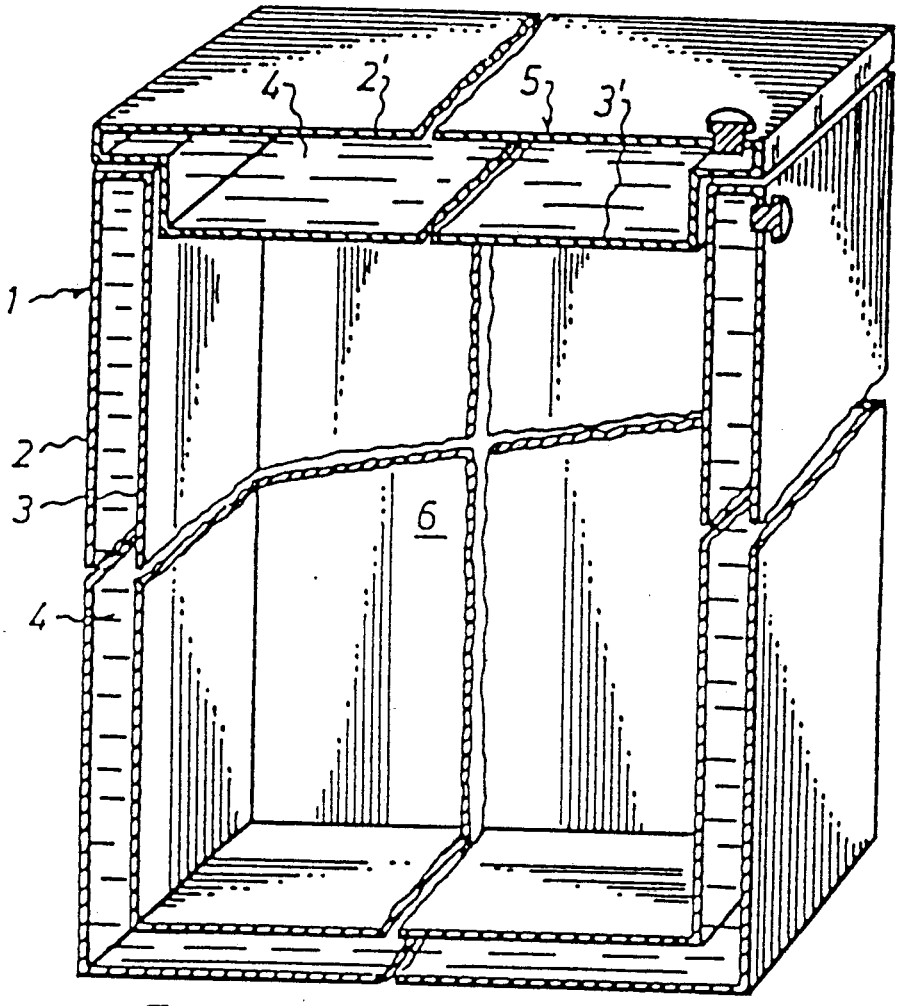

The present invention relates to a method of the type stated in the claim and a container therefor.

The quality properties of most fresh foodstuffs are highly affected by the temperature at which the foodstuffs are stored and distributed. On, for example, the producer's side there can be noted a strong trend towards chilled ready-cooked dishes holding a temperature about 0° C. as long as possible from the moment of production until the consumer buys the product in the shop. The essential thing is that the product does not reach a temperature below its freezing-point which may be lower than 0° C. if freezing-point lowering substances, such as salt, are included in the product. In fact, a slow refrigeration at a few degrees below zero deteriorates the structure and certain quality properties of the product.

Since foodstuffs requiring different temperatures are now co-distributed, it is difficult to maintain an unbroken chain of refrigeration around 0° C. for the products which, from the point of view of quality, require such a low temperature without reaching their own freezing-point.

U.S. Pat. No. 2,781,643 illustrates a method and a container for storing and distribution of foodstuffs at a temperature around 0° C. The known method and device, however, involve the use of a number of loose and removable water filled panels or screens to be taken out of the container, inserted in a refrigerating chamber to make the water therein freeze, removed from such chamber and reinserted as a loose jacket inside the foodstuff container; the bottom panel and the wall panels before the packing of the foodstuff and the lid, after such packing.

The object of the invention is to provide an improved method and arrangement in a container permitting the temperature to be maintained within limits set, where the manual handling of cooling panels, screens or the like is entirely eliminated and a sturdy, easy to handle, load and unload container.

The characteristic features of the invention are stated in the appended claims.

The invention is based on the idea that the product which is to be held at a fixed temperature, is shut off from the surroundings and enclosed in a container but together with products requiring the same temperature, the container being designed in such manner that it comprises a compartment which encloses the space for the products and holds a medium capable of storing cold. The medium is to be of such a type that it requires, because of its physical properties, a considerable supply of heat which is taken from the products, before its storing capacity decreases. Water is such a medium.

By integrating the pre-filled compartments in the walls, in the bottom and in the lid or in like, no extra measures—as compared with the handling of ordinary non-cool transport containers—are necessary but for the simple added measure to park the empty container with its door opened inside a freeze room until the water in the walls is frozen and the container is ready to be packed or taken out and be packed. There are no loose objects to be removed and inserted and of course no extra cleaning to be done beyond the normal cleaning of any foodstuff container.

Figure 2:
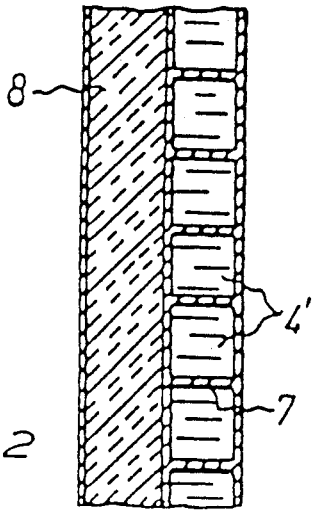
Figure 3:
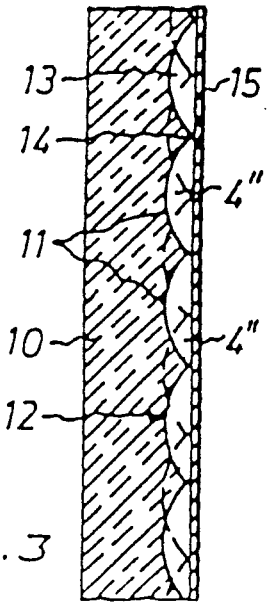

The invention will now be described in detail with reference to the accompanying drawing in which:

FIG. 1 is a schematic perspective view, partly in section, of a container adapted to the method according to the invention, FIG. 2 is a cross-sectional view of a portion of the wall in a modified embodiment, and FIG. 3 is a similar cross-sectional view of a portion of the wall in another modified embodiment.

The container 1 comprises an outer wall 2 and an inner wall 3 which define compartments 4. The compartments extend not only along the sides but also along the bottom which is also designed with a double wall. Also the lid which is designated 5, is provided with an outer layer 2 and an inner layer 3 which define a compartment 4. All said compartments are adapted to be filled with water with or without freezing-point affecting additives.

The container space designated 6 is adapted to receive the products which are to be stored or tranported.

The material of the container is of such a nature that it withstands considerable variations in temperature and is not impaired by the explosive effect which arises when the water in the wall, bottom and lid compartments 4, 4' freezes.

Both the outer and inner layer 2, 3 and, respectively, 2', 3' can be made of materials having a heat-insulating capacity, for example materials having a cell structure, but the insulating capacity is not always necessary.

For some goods very high containers are used, and then the height of the container causes a relatively high pressure in the lower portions of the compartments 4, if the different portions of the compartments 4 communicate with each other. The increase of pressure in the lower portions requires great strength and stability of the outer and inner walls or layers and may also require bracing of the walls or layers to make it possible to keep their thickness within reasonable dimensions.

In order to overcome the drawbacks of the pressure build-up caused by the height/depth of the space, the container can be arranged as shown in FIGS. 2 and 3. Instead of walls with coherent or communicating compartments, the water-containing compartments are, according to the embodiment shown in FIG. 2, formed of a large number of cavities 4' extending horizontally and defined by transverse walls 7. A layer 8 of insulating material is arranged along the outwardly facing side of the container wall formed of the parallel cavities. The thin channel walls 7 do not affect the cooling or melting function, but in this respect the channel-shaped cavities 4' act as a coherent space.

The walls, the bottom and the lid provided with the parallel cavities or channels 4' can be manufactured in that large panels formed with channels are cut, said channels being filled with water or some other suitable freezing liquid, and the ends of the channels being closed or sealed, before the different panel portions are joined together as a container. In the embodiment shown in FIGS. 2 and 3 it is thus not a matter of emptying the compartments 4' after each transport, but the liquid remains permanently. The small amount of liquid and, thus, the low weight imply that the return freight is not affected to any appreciable extent.

According to the embodiment in FIG. 3, the walls of the container 1 are made of rigid panels 10 of an insulating material, e.g. cellular plastic. The walls can also be foamed such that a strong integral surface layer is formed on the outside of the cellular or foamed material.

On the inwardly facing side of the wall panels 10, series of recesses 11 are arranged in rows along the entire panel surface in advance, preferably in connection with the manufacture of the panels. The recesses can, as indicated by dashed lines, be offset by half a step between the rows.

Against the inwardly facing side of the walls 10 shaped as indicated above, there are arranged foil sheets 12 having a large number of cushion-shaped portions 13 separated by web portions 14. Each cushion-shaped portion forms a compartment 4'' which is filled with water or a similar liquid.

In the embodiment shown in FIG. 3, the container walls, i.e. the panels of insulating material, are joined together before the foil sheets are arranged therein. The foil sheets can be made by prior art methods for manufacturing an impact-protecting multilayer foil, except that in connection with the manufacture of the foil sheets intended for the subject matter, each compartment 4'' is filled with water or a water mixture.

The cushions 13 positioned closely adjacent one another will act in substantially the same manner as a wall with coherent layers of liquid as shown in FIG. 1.

Against the inside of the foil sheet 12, there is arranged a sheet 15 of aluminium or like material having excellent thermal conductivity, and through this sheet heat/cold is distributed between the different compartments 4'' of the foil sheet 12.

The container is used in the following manner. The container including the compartments 4, 4', 4'' filled with water, optionally water to which common salt or some other freezing-point lowering agent has been added, is subjected to cold so that the water freezes. Subsequently, the container space 8 is filled with products to be stored/conveyed, and when being inserted, these products are to have the intended storing temperature.

The frozen water in the container compartment 4, 4', 4'' has stored the amount of cold required to compensate for the transfer of heat from the surroundings to the products in the container through the container walls, when the temperature outside the container is higher than the temperature of the products. When the outer temperature is lower, the ice has an insulating power in the opposite direction and prevents damage due to freezing. The ice forms a wall enclosing the products from all sides, said wall requiring a large addition of heat to be eliminated. Since during insertion into the container space, the products hold the intended temperature, i.e. close to 0°, there is but little heat in the products to melt the ice. The melting heat is instead recovered from the surroundings. The melting heat for ice, i.e. the addition of heat required to convert ice into water without increasing the water temperature, is used as a retarding factor to make the storing time sufficiently long.

When the ice begins to melt, the melted ice will, according to the embodiment shown in FIG. 1, collect at the very bottom of the compartment 4, i.e. on a level with the part of the container space which, because of the higher density of colder air, holds the lowest temperature. The successive melting of the ice will thus occur in such manner that the coldest medium—ice—will constantly be on the level of the container space where the temperature is most liable to rise, i.e. in the upper part.

When the container has been emptied of its contents, the water in the compartments 4 in FIG. 1 can be readily emptied to make the return weight as low as possible. By the use of plastic material with suitable properties, the container in FIG. 1 can, of course, also be made as a disposable package, and in that case the water is emptied as the container is discarded. In the embodiments shown in FIGS. 2 and 3, the water remains in the respective compartments 4' and 4''.

According to the invention, a simple and effective and not very costly method is provided for storing and conveying products which require a fixed temperature level, and this is achieved without requiring the use of gases, special refrigerating machines or highly insulated containers. As long as there is unmelted ice in the container compartments 4, 4', 4'', the intended temperature in the interior of the container is guaranteered. The only thing demanded from the packing or delivering station is that it must have a cold-storage room or the like in which the containers can be prepared, i.e. be cooled to such an extent that the water freezes. When necessary, the decreasing cold-retaining capacity can, of course, be improved during the transport in that the container is, in intermediate storing, placed in such a cold space that the ice which has already melted to water is frozen again. The risk that the temperature of the products then sinks below 0°, decreases significantly, since a large excess of cold outside the container is required, before all the water has passed into ice.

The method of using water and ice, respectively, as insulation implies that an even temperature around 0° C. can be maintained for a long time and that there is but a small risk that the temperature of the products sinks below the freezing-point if a moderate amount of cold is supplied to the container during transport and long storage.

The invention is not restricted to that described above and shown in the drawing but can be modified in various ways within the scope of the appended claims.

I claim:

1. A method for maintaining an intended temperature at or close to 0° C. in a product affected by variations in temperature, during transport and storage at an ambient temperature deviating from 0° C., while using a product holding container having walls, lid and bottom comprising:

freezing a multitude of integrated compartments which contain water or a water mixture and are arranged within the container walls, bottom and lid, so as to provide a water-tight assembly during transport and storage of the product;

inserting products having the intended temperature through an opening in said container and into a product receiving space after freezing said compartments;

arranging said walls, bottom, and lid such that said opening in said container is closed and said integrated compartments, with frozen water or water mixture, together provide a frozen water-containing confinement which encloses the product-receiving space from all sides.

2. A method as recited in claim 1 wherein said step of arranging said walls, bottom, and lid includes placing said lid against an upper edge of said walls so as to complete the enclosing of said frozen water containing confinement.

3. A method for maintaining an intended temperature at or close to 0° in products affected by variations in temperature, during transport and storage at an ambient temperature deviating from 0° C., while using a product holding container having water or ice containing screen means enclosing the product holding space of the container, characterized by the steps of; arranging a multitude of integrated compartments (4', 4'') containing water or a water mixture within the container (1) walls, bottom, and lid, said compartments together providing a water-containing confinement which is water-tight during use and encloses the product-receiving space (6) in the container from all sides; subjecting said container to cold so as to freeze the water in its wall compartments (4', 4''); inserting the products having the adapted temperature in said container after subjecting the container to freezing cold; and closing the container now ready for transport.

4. Arrangement in a container having a bottom, lid and walls for maintaining an intended temperature at or close to 0° C. in a product receiving and holding space inside said container and including ice-water compartment screening means enclosing the product holding space at the container, characterized in that in the container walls as well as in the bottom and the lid enclosing said space, there are permanently integrated and arranged a multitude of separate water or water mixture containing compartments, together forming, around said product holding space and after subjecting at least the interior of the container to a temperature below 0° C., a substantially coherent, enclosing layer of ice around said product holding space.

5. Arrangement according to claim 4, characterized in that the water or water mixture containing compartments are made of two foil layers joined in a lattice like pattern to form cushion shaped water containing compartments (4''), that a core of the walls of the bottom and of the lid is made of heat insulating cellular or foam material presenting recesses (11) for receiving the cushion shaped compartments.

6. Arrangement according to claim 5, characterized in that an interior surface material layer (15) preferably of sheet aluminum is attached to the inwardly facing side of the cushion shaped compartments (4'') for forming a smooth and even inside of the container.

7. The arrangement as claimed in claim 4, characterized in that said compartments (4') containing water or the like are formed of elongated channel-shaped spaces arranged adjacent each other, and that said channel-shaped spaces (4') extend along said walls, lid and bottom.

8. The arrangement as recited in claim 4 wherein said compartments are water-tight such that the water or water mixture is permanently retained within said compartments.

9. A container for maintaining an intended temperature at or close to 0° C. in a product receiving and holding space formed in said container, comprising:

walls having an upper edge, a lower edge and an interior and exterior surface, said walls further comprising water or water-mixture compartments permanently integrated in said walls and extending parallel to said upper and lower edges and between the interior and exterior surfaces of said walls, a bottom having a water or water-mixture compartment permanently integrated in said bottom;

a lid having a water or water-mixture compartment permanently integrated in said lid; and said water or water-mixture compartments being dimensioned and arranged such that when said walls, lid, and bottom are subjected to a temperature below 0° C. and assembled together, said compartments together form around the holding space a frozen water-containing confinement which encloses the product-receiving space from all sides.

* * * * *